US009345381B2

(12) United States Patent
Classen et al.

(10) Patent No.: US 9,345,381 B2
(45) Date of Patent: May 24, 2016

(54) WATER-CONDUCTING DOMESTIC APPLIANCE COMPRISING A DETERGENT DOSING SYSTEM

(75) Inventors: Egbert Classen, Wertingen (DE); Helmut Jerg, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 1825 days.

(21) Appl. No.: 12/311,097

(22) PCT Filed: Aug. 30, 2007

(86) PCT No.: PCT/EP2007/059074

§ 371 (c)(1),
(2), (4) Date: Nov. 17, 2009

(87) PCT Pub. No.: WO2008/034705

PCT Pub. Date: Mar. 27, 2008

(65) Prior Publication Data

US 2010/0071729 A1 Mar. 25, 2010

(30) Foreign Application Priority Data

Sep. 19, 2006 (DE) ..... 10 2006 043 974

(51) Int. Cl.

| | |
|---|---|
| ***A47L 15/00*** | (2006.01) |
| ***A47L 15/44*** | (2006.01) |
| ***D06F 39/02*** | (2006.01) |

(52) U.S. Cl.

CPC ..... *A47L 15/4463* (2013.01); *A47L 15/4454* (2013.01); *A47L 15/4472* (2013.01); *D06F 39/022* (2013.01)

(58) Field of Classification Search

CPC . A47L 15/44; A47L 15/4472; A47L 15/4463; A47L 15/4445; A47L 15/4454; A47L 15/449

USPC ..... 134/56 D, 57 D, 58 D, 93, 99.2

See application file for complete search history.

(56) References Cited

U.S. PATENT DOCUMENTS 6,138,693 A * 10/2000 Matz ..... A47L 15/4418 134/100.1

2005/0126608 A1 6/2005 DeWeerd et al.

(Continued)

FOREIGN PATENT DOCUMENTS

DE 1938198 U 5/1966
DE 3903636 A1 8/1990

(Continued)

OTHER PUBLICATIONS

Report of Examination DE 10 2006 043 974.0, 2012.

*Primary Examiner* — David Cormier

(74) *Attorney, Agent, or Firm* — James E. Howard; Andre Pallapies

(57) ABSTRACT

A water-conducting domestic appliance, in particular a domestic dishwasher, the water-conducting domestic appliance including a washing compartment for receiving items therein that are to be subjected to a washing cycle by the water-conducting domestic appliance; a door movable between an open position for permitting access to the washing compartment and a closed position for preventing access to the washing compartment; and a detergent dosing system, the detergent dosing system having a detergent dispenser with a receiving compartment, the receiving compartment for receiving at least one cartridge that is configured to hold at least one detergent, the detergent dosing system having the capability to store a quantity of detergent greater than a quantity needed for a single washing cycle and the one receiving compartment being configured such that, in the event that the door is partially opened, at least one cartridge can be inserted into the receiving compartment.

14 Claims, 3 Drawing Sheets

(56) References Cited

U.S. PATENT DOCUMENTS

| | | | |
|---|---|---|---|
| 2007/0144558 | A1 | 6/2007 | Classen et al. |
| 2007/0210118 | A1 | 9/2007 | Gadini |

FOREIGN PATENT DOCUMENTS

| | | | | | |
|---|---|---|---|---|---|
| DE | 19843976 | A1 | | 4/1999 | |
| EP | 1281346 | A1 | | 2/2003 | |
| EP | 0858768 | B1 | | 4/2003 | |
| WO | 0220893 | A1 | | 3/2002 | |
| WO | 0229150 | A1 | | 4/2002 | |
| WO | WO 2005058126 | A1 | * | 6/2005 | ..... A47L 15/4418 |
| WO | WO 2005100675 | A2 | * | 10/2005 | ..... A47L 15/44 |

* cited by examiner

WATER-CONDUCTING DOMESTIC APPLIANCE COMPRISING A DETERGENT DOSING SYSTEM

BACKGROUND OF THE INVENTION

The invention relates to a water-conducting domestic appliance in accordance with the preamble of claim 20.

The majority of domestic dishwashers currently in use possess a dispenser for holding one or more detergents which are dispensed within the course of a dishwashing cycle into the washing liquor for cleaning the dishes arranged in the dishwasher. Usually the detergent stored in the dispenser is fully dispensed during the washing cycle into the washing area and mixed in with the washing liquor being agitated therein. The size of the dispenser is dimensioned such that the quantity of detergent needed immediately for the washing cycle can be dispensed. The user of the dishwasher is therefore forced, at the beginning of each washing cycle, to fill the dispenser with the quantity of detergent needed for the washing cycle. This process is inconvenient for the user of the dishwasher. In addition, with dishwashers of this type, there is the problem of the quantity of detergents put into the dispenser being able to vary from user to user, but also from wash to wash. An incorrect dose of detergent can on the one hand lead to unsatisfactory washing results if the detergent was too small, and on the other hand to a waste of detergents and thus a strain on the environment if the dose of detergent was too large.

Dispensers which add the stored quantity of detergent to the washing liquor all at once also do not allow more complex washing programs to be executed. It can thus be sensible in specific situations for detergents to be dosed into the washing liquor at different points in time. Dispensers which are embodied for holding a single detergent dose cannot support these types of complex washing cycles.

BRIEF SUMMARY OF THE INVENTION

The object of the present invention is thus to specify a water-conducting domestic appliance which does not have this described disadvantage and is convenient to use. A further object of the invention is to provide corresponding aids.

This object is achieved by a water-conducting domestic appliance with the features of claim 1. Advantageous embodiments emerge from the dependent claims.

An inventive water-conducting domestic appliance, especially a domestic dishwasher, includes a detergent dosing system, with the detergent dosing system featuring a detergent dispenser with a receiving area for receiving at least one cartridge, with the cartridge being embodied to hold at least one detergent. The invention is characterized in that the quantity of detergent able to be stored is greater than the quantity needed for a washing cycle and the at least one receiving area is embodied such that, with a partly opened door of the water-conducting domestic appliance, at least one cartridge (50) is able to be fitted into the at least one receiving area. In this case the detergent dosing system, for arrangement adjoining a washing area of the dishwasher for example, can be embodied in the inside of the dishwasher or between an inner and outer door of a dishwasher door. The detergent dosing system is embodied to hold at least one detergent which can be in one or in a plurality of replaceable cartridges, with the stored quantity of each detergent being greater than the quantity needed for a washing cycle. Detergents, for example liquid detergents, can be compounds of a plurality of substances or alternatively can be cleaning components such as individual enzymes for example. The detergent dosing system essentially provides precisely the quantity of detergent that is necessary for the washing cycle, with the detergent dosing system being arranged in the area of a door sealing the washing area. To this end the detergent dosing system has a connection to the dishwasher controller.

The invention makes it possible for a user to add detergents to the detergent dosing system if the door is hinged at only a slight angle in relation to its upright closed position. A slight angle is in this case to be understood as an angle which is sufficient for the top face of the door to be visible to or accessible to the user, for example 10°-30°. By contrast to the prior art it is not necessary to hinge the door down completely and put it into a horizontal position, in which it is possible to withdraw a lower crockery basket. The insertion opening on the end face side of the door means that no contaminants can penetrate into the detergent dosing system area when the dirty dishes are being loaded into the dishwasher. This imposes lower demands on the sealing of the detergent dosing system in relation to contamination. Usability for the user of the dishwasher is also improved since users can be standing up when filling and emptying the detergent dosing system.

There is preferably provision for the at least one receiving area to feature an insertion opening for at least one cartridge in the area of an inner side or a panel of the door. Alternatively an insertion opening can also be arranged on side edges of the door which are only accessible when the door is opened. The detergent dispenser can thus be fitted within the area of the inner section or in the area of a panel of the door. The arrangement of the inventive detergent dosing system in the area of the door is thus not visible from outside when the door is closed. This is thus not associated with adverse effects on the look of the outer door.

The detergent dispenser is preferably arranged in an upper third of the door and provides the receiving area for at least one cartridge with the detergents. In particular the detergent dispenser of the detergent dosing system is arranged in a side section in relation to the center of the door. This does not produce any spatial conflict with the usually central arrangement of the locking system for locking the door of the dishwasher with the container. In addition control elements can be arranged in the other half of the end face side of the door.

In one embodiment the detergent dispenser includes a cover which, in a closed position is arranged level with the end face side of the door and is able to be hinged around an axis placed at the level of the end face side in order to release the receiving area for inserting the cartridge. The provision of a cover prevents contaminants or moisture getting into the receiving area and if necessary getting into the cartridge holding the detergents. On the other hand this ensures a uniform appearance of the end face of the door.

Expediently a dog is embodied on the cover which, with a cartridge arranged in the receiving area, can be brought into an effective connection with this so that the cartridge with an opened cover can be easily lifted out of the receiving area and with a closed cover the cartridge is able to be brought into a predetermined position. As well as its protective function, the cover also assumes the task of raising the cartridge when the cover is opened for easier removal, so that at least one cartridge executes a movement towards the user. On the other hand the cover is used to establish a required position of at least one cartridge in the receiving area of the detergent dispenser.

A section of the detergent dosing system oriented towards the washing area of the water-conducting domestic appliance features heat insulation which restricts a flow of heat from the washing area in the direction of the detergent dosing system.

Advantageously this method ensures the long-term stability of the detergents held in the detergent dosing system. This allows the use of detergents which include temperature-sensitive substances. The heat insulation in the section oriented towards the washing area of the dishwasher suppresses or limits disproportionately high temperature fluctuations of the detergents held in the detergent dosing system. This method of operation is especially of advantage if the stored quantity of detergent is designed for a very large overall number of wash cycles. As a result of the integral component of the inventive detergent dosing system of the dishwasher the insulation can be matched to the washing cycles to be performed by the dishwasher and the temperature curves occurring during said cycles. In particular in such cases sections with different insulation capabilities can be provided.

The insulation can be formed by a volume of gas arranged in the section. This can be produced by the gas-assisted injection molding (GID) method known from the prior art in which a gas cavity is enclosed in the section made from material able to be injection molded, e.g. plastic. The insulation can also be formed by an insulation material arranged in the section. This insulator material can be present in addition to the material of the housing component. The housing component can also be formed from the insulator material.

The detergent dispenser or at least one cartridge inserted into the holder have at least one outlet with an operational connection to the washing area, via which a defined quantity of detergent is able to be fed into the washing liquor during a dishwashing cycle. The at least one outlet is provided in one embodiment on a housing section of the detergent dispenser which is arranged in the direction of gravity below the holder area. A number of outlets can be provided in this case which correspond to the number of detergents to be held in the cartridge or the number of chambers of the cartridge holding detergents.

A closure for opening and closing an outlet is assigned to the at least one outlet, to enable the detergent to be dispensed or dosed from the at least one cartridge into the washing area. In addition the detergent dispenser can feature at least one dosing chamber and the at least one outlet of the detergent dispenser can come out into the at least one dosing chamber, in which case the closure is arranged in the dosing chamber. This means that the closure is able to influence the release of detergents into the washing chamber. In particular a selective dosing of different detergents at different points in time is possible, if each detergent or each chamber of at least one cartridge is assigned its own outlet along with a closure.

The dispensing and/or dosing of at least one detergent can be undertaken by a pump. In an alternate embodiment the apparatus for dispensing at least one detergent can be embodied by the effect of gravity for dosing over a definable delivery period.

At least one detergent located in at least one cartridge can be stored in liquid and/or gel form. In this case there is special provision for all detergents necessary for a cleaning cycle to be stored in the cartridge and to be in liquid and/or gel form. The provision of further detergent deliveries in addition to the inventive detergent dosing system is thus superfluous.

A cartridge also forms part of the invention.

BRIEF DESCRIPTION OF THE DRAWINGS

The invention will be explained in greater detail below with reference to the figures. The figures are as follows.

DETAILED DESCRIPTION OF THE PRESENT INVENTION

Figure 1:
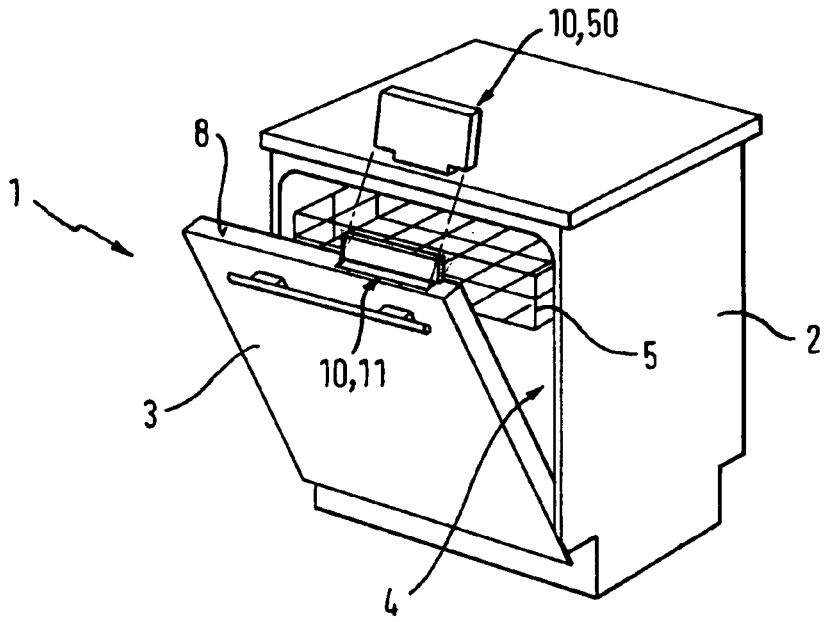
FIG. 1 an inventive dishwasher with a detergent dosing system which is arranged in the door of the dishwasher, FIG. 2 a section through a detergent dosing system arranged in the door of the dishwasher, and FIG. 3 an exemplary embodiment of a cartridge for use in the detergent dosing system of the inventive dishwasher.

FIG. 1 shows an inventive dishwasher 1 which features a door 3 supported hingeably on a housing 2. The door 3 is hinged open at a slight angle in the figure. Arranged in the known manner in a washing area 4 able to be sealed by the door 3 are crockery baskets, of which only an upper crockery basket 5 is visible in the figure. A detergent dosing system 10, comprising a detergent dispenser 11 and a cartridge 50 which contains at least two detergents stored separately from one another, is arranged in the door 3 of the dishwasher.

The detergent dispenser 11 is loaded with the cartridge 50 from an end face side 8 of the door. The opening for loading the cartridge into the detergent dispenser 11 can be arranged in the area of a panel of the dishwasher or the inner section of the door. The advantage of the arrangement of the detergent dosing system 10 in the door 3, with the option of inserting the cartridge into this from above, lies in the convenience of cartridge insertion and removal for the user. As can be easily seen from FIG. 1 the insertion and removal is undertaken in a side section of the end face side 8 of the door 3. This means that a different embodiment of the locking system for locking the door to the housing of the dishwasher 1 usually arranged centrally in conventional dishwashers is not needed. In addition there is the option of also arranging control elements on the end face side 8 of the door 3. This produces a uniform appearance in the outer area of the door 3.

Figure 2:
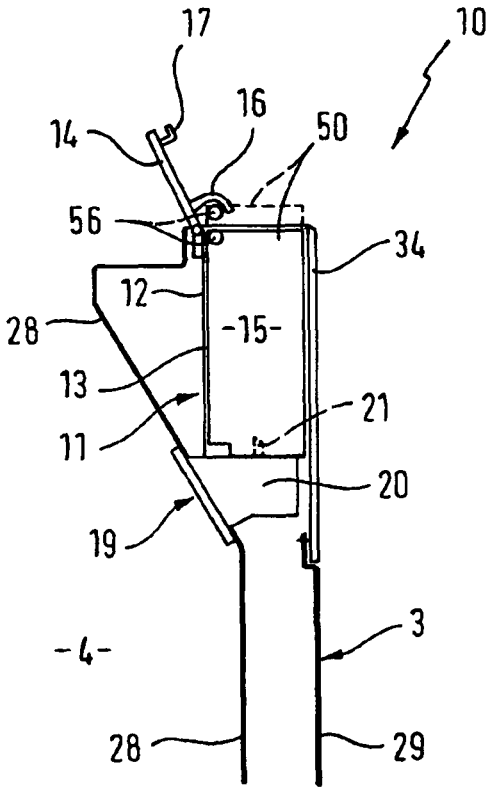

The embodiment of the detergent dosing system 10 is shown more precisely in the cross sectional view depicted in FIG. 2. The figure shows a section through the door 3 of the dishwasher shown in FIG. 2. The detergent dispenser 11 is arranged between a panel 34 and an inner door 28. In a known manner the panel 34 delimits an outer door 29 visible from the outside to the user. In the area of its front side the detergent dispenser 11 has a cover 14 which is hingeable on a housing 12 of the detergent dispenser 11. The cover 14 features two latching hooks of which the hook which is closer to the hinge axis (reference symbol 16), latches into a projection 56 formed on the cartridge 50. When the cover 14 is opened this causes the cartridge 50 to be lifted slightly for easier removal by the user. The latching hook 17 further away from the hinge axis is used for latching the cover 14 with the housing 12.

When the cover 14 is closed and the cartridge 50 is inserted, the cartridge is pressed downwards by the cover 14 and the relative displacement of the latching hook 16 and projection 56 on the cartridge 50, so that tubes 21 provided in the detergent dispenser 11 project through correspondingly arranged seals in the cartridge 50. Arranged below the tubes 21 is a dosing chamber 20 in each case which has a connection via the corresponding outlets 19 to the washing area 4.

Arranged in each of the dosing chambers 20 is a seal (not shown), which consists of a movably supported seal in the dosing chamber 20 and a drive mechanism for the seal. The seal is formed such that it is able to be moved between a position closing off the associated outlet and a position releasing the outlet. For this purpose the seal can be connected to a valve plunger effectively connected to a valve actuation lever. On actuation of the valve actuation lever the seal is removed from the outlet. If the valve actuation lever is moved back into its initial position a resetting force is built up by a spring tensioned between a housing cover and an opposing support provided on the valve plunger which applies the seal to the inside of the outlet.

If the seal is in its open position, the detergent located in an assigned chamber because of gravitational force or an active feed device, such as a pump for example, can pass through the tube 21 into the dosing chamber 20 and pass via the outlet 19 into the washing area.

In this case the detergent can be transported exclusively using the force of gravity. The transport device, especially the embodiment of the seal, can however also be constructed according to the principle of a pump, so that a corresponding vacuum transports detergent from the washing chamber into the dosing chamber 20 and by a corresponding feed pressure from the dosing chamber 20 into the washing area.

To restrict a flow of heat from the washing chamber in the direction of the detergent dispenser 10 or the detergent located in the cartridge 50, the housing wall of the detergent dispenser identified by the reference symbol 13 can be equipped with insulation.

Figure 3:
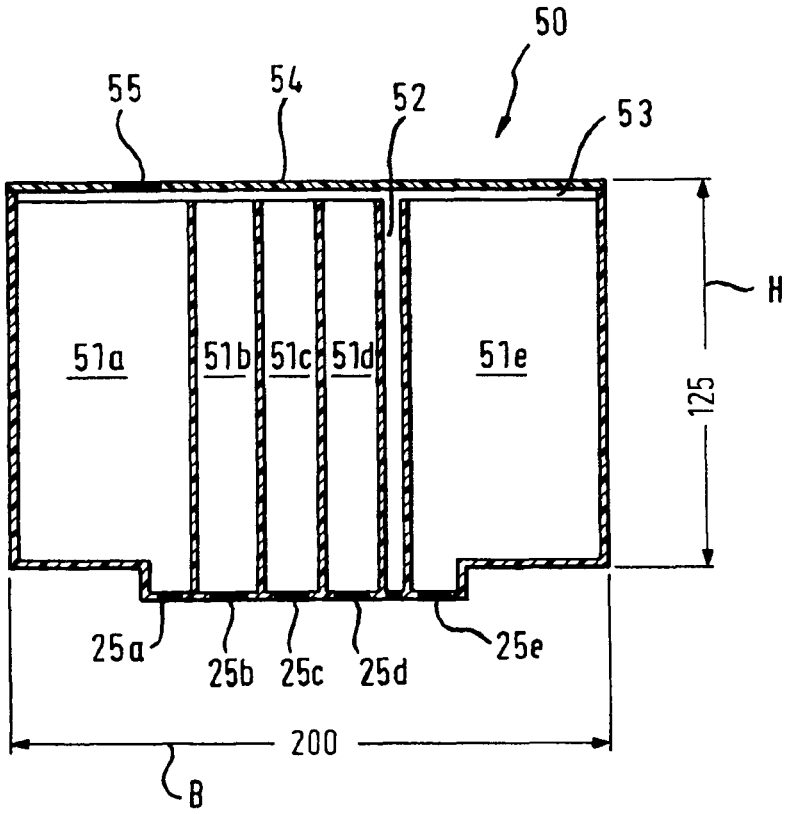

A typical embodiment of the cartridge 50 is shown in FIG. 3. The cartridge 50 typically features five chambers 51*a*, 51*b*, 51*c*, 51*d* and 51*e*, for holding a detergent or a detergent mixture in each case. The size of the individual chambers 51*a* through 51*e* is preferably dimensioned in this case in accordance with the volume required during a predetermined number of wash cycles. Preferably the volume of the different detergents in the chamber 51*a* through 51*e* is dimensioned such that, after a certain number of wash cycles, preferably between 20 and 40, further preferably appr. 30, all of the chambers 51*a* through 51*e* are completely emptied. Each of the chambers 51*a* through 51*e* is provided with an openable seal 25*a* to 25*e* in the form of a membrane, a film or an elastomer. The closure closes off the individual chambers 51*a* through 51*e* tightly, so that during storage and transport of the cartridge 50 no detergent can escape from the latter. On insertion of the cartridge 50 into the detergent dispenser 11 the closures are penetrated by the tubes 21 arranged correspondingly in the detergent dispenser 11 (cf. FIG. 2), so that in accordance with a corresponding dosing device detergents can be fed into the washing area.

The cartridge is preferably made of a plastic and has a width B of appr. 200 mm, a height H of appr. 125 mm and a depth of appr. 25 mm. For these dimensions the volume of the different chambers can be dimensioned so that the desired 20 to 40 washing cycles can be performed by means of one cartridge.

As well as the chambers 51*a* through 51*e* the cartridge 50 has a further chamber 52, which is connected with one or more ventilation channels 53. The ventilation channel or channels 53 on the other hand have a connection to the different chambers 51*a* through 51*e*. In this way it is ensured that with increasing emptying of the chambers 51*a* through 51*e* no vacuum can build up within these, which would make it difficult to feed the detergents or would feed the incorrect amount. The ventilation channels 53 are preferably located in a cover 54, which is fitted after the filling of the individual chambers 51*a* through 51*e* with the respective detergents to the housing of the cartridge. The cover 54 can feature an overpressure valve 55 which may be necessary with specific detergent components.

Since the detergents contained in the cartridge 50 are only dosed gradually within the framework of a plurality of washing cycles into the washing area, or more precisely into the washing liquor agitated in the washing area, these are subjected with each washing cycle to considerable absolute temperatures and temperature variations. In order to prevent the characteristics of the detergents changing over time because of this, at least one housing area of the cartridge 50 facing towards the washing area can be made from an insulating material or also surrounded by insulation 33. This restricts a heat flow from the washing area in the direction of the detergent dosing system or restricts the detergent stored in the cartridge, so that the long-term stability of the detergents used is guaranteed. The insulation 33 can be formed by a gas volume arranged in the relevant housing section of the cartridge. This gas volume creating the insulation can be inserted during the manufacturing of the cover or of the cartridge. The method used in this case is known as the gas-assisted molding method (GID).

As well as the holder for the cartridge the detergent dispenser 11 can feature a further chamber for receiving a solid detergent (not shown). The solid detergent can for example involve a 3-in-1 tab which is inserted into the further chamber if no cartridge or an empty cartridge 50 is contained in the receiving chamber 15. The provision of the further chamber for receiving the solid detergent makes it possible to also use the dishwasher if the cartridge 50 is empty and no filled cartridge is available.

To detect an empty or nearly empty cartridge, the detergent dosing system can have means available to it for interrogating the fill level of the detergent in the cartridge. If the detergent in one or more of the chambers of the cartridge reaches a predetermined fill level, e.g. if a predetermined number of wash cycles is still possible, this can be displayed to the user via an optical signal. The display device can in a known way be located on the outside of the door for example, e.g. the panel.

The fill level can be interrogated in an optical, capacitive or acoustic manner. For an optical interrogation an optical fiber could be inserted into the cartridge which interrogates the fill level using a light source available in the detergent dispenser. For a capacitive interrogation the detergent present in the cartridge can be employed as a dielectric. An acoustic coupling can be undertaken for example by exploiting the piezo ultrasound principle. Alternatively a counter can be employed to count the washing cycles already executed of a full cartridge. To detect a new cartridge this can be equipped with a transponder able to be read out by the dishwasher or detergent dispenser. Alternatively another code, e.g. a bar code can be affixed to the cartridge. The code can be read in when the cartridge is inserted into the detergent dispenser.

The present invention creates a dishwasher which improves handling for its users.

LIST OF REFERENCE SYMBOLS

1 Dishwasher
2 Housing
3 Door
4 Wash area
5 Crockery basket
8 End face side of the door
10 Detergent dosing system
11 Detergent dispenser
12 Housing
13 Housing wall
14 Cover
15 Receiving area
16 Latching hook
17 Latching hook
19 Outlet
20 Dosing chamber
21 Tube

25*a*-25*e* Membrane
28 Inner door
29 Outer door
34 Panel
50 Cartridge
51*a*-51*e* Chamber for detergents
52 Chamber for ventilation
53 Ventilation channel
54 Cover
55 Overpressure valve
56 Projection
H Height
B Width

The invention claimed is:

1. A dishwasher comprising:

a washing compartment for receiving items therein that are to be subjected to a washing cycle;

a door movable between an open position for permitting access to the washing compartment and a closed position for preventing access to the washing compartment; and a detergent dosing system, the detergent dosing system having a detergent dispenser with a receiving compartment, the receiving compartment disposed on an upper third area of the door such that it is accessible when the door is hinged at an angle of 30°or less and for receiving at least one cartridge that is configured to hold at least one detergent, the detergent dosing system structured to store a quantity of detergent for use in a plurality of washing cycles, and the detergent dosing system including a dosing device to dispense a predetermined quantity of the detergent less than the stored quantity during the single washing cycle, wherein the detergent dispenser includes a cover which in a closed position is arranged in the plane of an end face side of the door and is hinged around an axis positioned in the plane of the end face side, and further comprising a dog formed on the cover which, when a cartridge is arranged in the receiving compartment, is structured to connect to the cartridge to engage the cartridge with the receiving compartment when closed, and partially remove the cartridge from the receiving compartment when opened.

2. The dishwasher according to claim 1 wherein the detergent dispenser is offset from a center of the door.

3. The dishwasher according to claim 1 wherein a housing wall of at least one of the detergent dosing system and the detergent dispenser oriented towards the washing area of the dishwasher includes heat insulation.

4. The dishwasher according to claim 3 wherein the heat insulation is formed as a predetermined volume of gas.

5. The dishwasher according to claim 3 wherein the heat insulation is formed from insulator material.

6. The dishwasher according to claim 1 wherein the detergent dispenser has at least one outlet actively connected to the washing area for delivery therethrough of a predetermined quantity of detergent to a washing liquor at least one of before a washing cycle and during a washing cycle.

7. The dishwasher according to claim 6 wherein the at least one outlet is provided on a housing section of the detergent dispenser which is arranged in the direction of gravity below the receiving compartment.

8. The dishwasher according to claim 6 wherein the at least one outlet includes a plurality of outlets wherein a number of the plurality of outlets correspond to at least one of a number of detergents held in at least one cartridge and a number of chambers accepting detergents of at least one cartridge.

9. The dishwasher according to claim 8 wherein a closure for opening and closing the at least one outlet is disposed on the at least one cartridge.

10. The dishwasher according to claim 6 wherein the at least one outlet of the detergent dispenser extends into at least one dosing chamber, with the at least one dosing chamber being assigned to the detergent dispenser.

11. The dishwasher according to claim 1 wherein the dosing device is provided for at least one of feeding the at least one detergent and dosing the at least one detergent.

12. The dishwasher according to claim 1 wherein the detergent dispenser is configured for delivering at least one detergent through the effect of gravity.

13. The dishwasher according to claim 1 wherein the detergent dispenser is configured for dosing the at least one detergent over a predetermined delivery time period.

14. The dishwasher according to claim 1 wherein detergent located in at least one inserted cartridge is in at least one of liquid form and gel form.

* * * * *